US006031507A

United States Patent [19]

Aoki

[11] Patent Number: 6,031,507

[45] Date of Patent: Feb. 29, 2000

[54] ANTENNA APPARATUS

[75] Inventor: Katsuhiko Aoki, Tokyo, Japan

[73] Assignee: Mitsubishi Denki Kabushiki Kaisha, Tokyo, Japan

[21] Appl. No.: 09/112,983

[22] Filed: Jul. 10, 1998

[30] Foreign Application Priority Data

Feb. 6, 1998 [JP] Japan ..... 10-026182

[51] Int. Cl.[7] ..... H01Q 19/12; H01Q 13/00

[52] U.S. Cl. ..... 343/840; 343/776; 343/779

[58] Field of Search ..... 343/779, 840, 343/781 R, 834, 835, 772, 775, 776

[56] References Cited

U.S. PATENT DOCUMENTS 3,495,262 2/1970 Paine ..... 343/776
4,096,482 6/1978 Walters ..... 343/778
4,355,316 10/1982 Hwang et al. ..... 343/840
4,851,858 7/1989 Frisch ..... 343/779

FOREIGN PATENT DOCUMENTS 55-153402 11/1980 Japan .
56-119904 9/1981 Japan .

OTHER PUBLICATIONS

Technical Report vol. 71, No. 9, 1997 of Mitsubishi Electric "Super–small satellite communication terminal device".

*Primary Examiner*—Don Wong
*Assistant Examiner*—Jennifer H. Malos
*Attorney, Agent, or Firm*—Rothwell, Figg, Ernst & Kurz

[57] ABSTRACT

To obtain a high-performance antenna apparatus free from the shift of its focusing point, there are provided a plurality of pairs of horns, horns of each pair are arranged at opposite positions with respect to the center of the plurality of horns, and each pair of horns operates at a different frequency band.

12 Claims, 15 Drawing Sheets

ANTENNA APPARATUS

BACKGROUND OF THE INVENTION

1. Field of the Invention

This invention relates to an antenna apparatus used for satellite communication and, specifically, to an antenna apparatus used at an earth station provided with a radio telescope.

2. Description of the Prior Art

FIG. 15(*a*) shows the configuration of a conventional offset paraboloidal reflector antenna apparatus described, for example, in "Very Small Aperture Terminal for Satellite Communication", Mitsubishi Electric Technical Report, vol. 71, No. 9, 1997. Reference numeral 1 denotes an offset paraboloidal reflector antenna (to be referred to as "paraboloidal reflector antenna" hereinafter) which is a main reflector, 2 a horn having a circular aperture for both transmission and reception, 3 a feeder circuit, 4 a transmitter, and 5 a receiver. Reference letter P indicates the focusing point of the paraboloidal reflector antenna 1.

In satellite communication, different frequencies are allocated to transmission and reception. For example, when the frequency band is a Ku band, 14 GHz is used for transmission from the earth to the satellite and 12 GHz is used for transmission from the satellite to the earth (reception on the earth). In this case, the feeder circuit 3 comprising a transmit-receive branching filter 30A is connected to the horn 2 as shown in FIG. 15(*b*) and the transmitter 4 and the receiver 5 are connected to the above transmit-receive branching filter 30A. When the frequency band is a Ka band, 30 GHz is used for transmission from the earth to the satellite and 20 GHz is used for reception on the earth. In this case, as shown in FIG. 15(*c*), the feeder circuit 3 comprises a circular polarizer 30B and the transmit-receive branching filter 30A. In either case, the horn 2 and the transmit-receive branching filter 30A or the circular polarizer 30B must be designed to be used for both transmission and reception. The configuration of the feeder circuit 3 shown in FIG. 15(*b*) is used in a satellite system using linearly polarized waves and the configuration of the feeder circuit 3 shown in FIG. 15(*c*) is used in a satellite system using circularly polarized waves.

A description is subsequently given of the operation of the above-structured antenna apparatus. In the satellite system using linearly polarized waves shown in FIG. 15(*b*), waves from the satellite are received by the paraboloidal reflector antenna 1 and guided from the horn 2 to the receiver 5 through the transmit-receive branching filter 30A. On the other hand, signals from the transmitter 4 are transmitted to the horn 2 through the transmit-receive branching filter 30A and radiated from the paraboloidal reflector antenna 1 to the satellite. In the satellite system using circularly polarized waves shown in FIG. 15(*c*), waves (circularly polarized waves) received from the satellite are transmitted from the horn 2 to the circular polarizer 30B to be converted into linearly polarized waves which are then guided to the receiver 5 through the transmit-receive branching filter 30A. Transmission waves (linearly polarized waves) from the transmitter 4 are transmitted from the transmit-receive branching filter 30A to the circular polarizer 30B to be converted into circularly polarized waves which are then transmitted to the horn 2 to be radiated from the paraboloidal reflector antenna 1 to the satellite.

In the conventional antenna apparatus, since the horn, the transmit-receive branching filter and the circular polarizer are used for both transmission and reception as described above, they must operate at a wide frequency band including a transmission frequency band and a reception frequency band. Therefore, they become bulky and are not economical. For instance, in the case of the above Ka band, a 20 GHz frequency band of 17.7 to 21.2 GHz (bandwidth of 3.5 GHz) is allocated to reception and a 30 GHz frequency band of 27.5 to 31.0 GHz (bandwidth of 3.5 GHz) is allocated to transmission in satellite communication. That is, the bandwidth ratio (percentage of the ratio of bandwidth to band average frequency) of each frequency band is 18% for a 20 GHz frequency band and 12% for a 30 GHZ frequency band. When the frequency band is used for both transmission and reception, the frequency band for both transmission and reception ranges from 17.7 to 31.0 GHz (bandwidth of 13.3 GHz) and hence, the bandwidth ratio is 55%. Since the use frequency band is broad when the frequency band is used for both transmission and reception, in the design of an antenna apparatus which uses a frequency band for both transmission and reception, circuit design becomes complicated, circuit scale becomes large, high work accuracy is required, and electrical adjustment takes time to achieve targeted performance. In addition, skill for the precise adjustment of a circuit is required. Thus, compared with the design of an antenna apparatus which uses different frequency bands exclusive for transmission and reception, this antenna apparatus involves a large number of problems to be solved.

To cope with the above problems, an antenna apparatus equipped with primary radiators, each comprising a horn and a feeder circuit for each frequency band, as shown in FIG. 16(*a*) is conceivable. This antenna apparatus comprises a horn 2A dedicated for a lower frequency ($f_1$) and a horn 2B dedicated for a higher frequency ($f_2$) which are arranged near the focusing point P of the paraboloidal reflector antenna 1. The horn 2A is connected to a feeder circuit 3A dedicated for $f_1$ and a feeder circuit 3B dedicated for $f_2$.

Since the horns 2A and 2B must be shifted away from the focusing point P of the paraboloidal reflector antenna 1 in a direction perpendicular to the axial direction, radiation patterns from the paraboloidal reflector antenna 1 are displaced from the front direction of the paraboloidal reflector antenna 1 as shown in FIG. 16(*b*). The radiation patterns of $f_1$ and $f_2$ are displaced in opposite directions. That is, the radiation patterns from the paraboloidal reflector antenna 1 cause the displacement of a beam which is determined by the off-axis shift of the horns and the parameter of the paraboloidal reflector antenna 1. When the paraboloidal reflector antenna 1 is directed toward the front direction, neither the radiation pattern of fi nor the radiation pattern of $f_2$ does not take maximal values. Therefore, when the two horns for $f_1$ and $f_2$ are arranged near the focusing point of the paraboloidal reflector antenna 1, the best solution that the operation gains of both $f_1$ and $f_2$ become maximal cannot be obtained due to the displacement of a beam during actual operation. That is, when the paraboloidal reflector antenna 1 is directed toward the front direction, the operation gains of both $f_1$ and $f_2$ become lower than their maximum gains. When the paraboloidal reflector antenna 1 is directed toward a direction in which the operation gain of one frequency (for example, $f_1$) becomes maximal, the operation gain of the other frequency ($f_2$) lowers.

An antenna apparatus having a plurality of horns is disclosed, for example, by Japanese Laid-open Patent Application No. Sho 56-119504. FIG. 17(*a*) shows the configuration of the antenna apparatus and FIG. 17(*b*) is a front view of its horns. In the antenna apparatus in which a center horn 2Z is used and multiple frequencies are shared, since the focusing point P of the paraboloidal reflector antenna 1 is aligned with the center horn 2Z for transmission, the center horn 2Z determines the array interval between peripheral horns 2C and 2D for reception. Thus, the relationship among the center frequency and the peripheral frequency is limited. That is, the above-structured antenna apparatus is effective when the transmission frequency is separated from the reception frequency (about 5 times in the above example). However, since the center frequency (transmission) is 30 GHz and the peripheral frequency (reception) is 20 GHz in the case of the above-described Ka band, the difference between these frequencies is small (1.5 times), whereby the synthesized primary radiation pattern at 20 GHz becomes too narrow.

FIG. 18(*a*) shows the configuration of an antenna apparatus having a plurality of horns disclosed by Japanese Laid-open Patent Application No. Sho 55-153402 in which a pair of horns 2E and 2F are arranged around the focusing point P of the paraboloidal reflector antenna 1 in such a manner that the center axes of the horns cross each other at the focusing point P to enhance the performance of the antenna. That is, as shown in FIG. 18(*b*), the center axes of the horns 2E and 2F are inclined toward the symmetry plane Sq of the paraboloidal reflector antenna 1 so that the horns 2E and 2F can radiate waves onto left and right portions of a reflector, respectively. Owing to this, radiation patterns onto the reflector surface of the paraboloidal reflector antenna are controlled and the level of field strength synthesized by the horns 2E and 2F in a front direction is made flat as shown in FIG. 18(*c*) to achieve high performance for the antenna. When the phase center of each horn (focusing points of the horns denoted by 11E and 11F of FIG. 18(*b*)) is not located on the center axis of each horn and outside each horn, it is impossible to align the focusing point P of the paraboloidal reflector antenna 1 with the phase center of each horn. However, in the case of a rectangular horn having a square aperture, as the phase center is located on the aperture of the horn or within the horn, an antenna apparatus as described above cannot be constructed using the rectangular horn.

It is possible to bring the phase centers 12E and 12F of the horns 2E and 2F a little close to the focusing point P by inserting a dielectric bar 2G into the horns 2E and 2F in such a manner that it extends from the root of each horn through the aperture to the outside as shown in FIG. 18(*d*). However, it is structurally difficult to align the focusing point P of the paraboloidal reflector antenna 1 with the phase center of each horn.

SUMMARY OF THE INVENTION

It is an object of the present invention which has been made to solve the above problems to provide a high-performance and simple-structured antenna apparatus which comprises primary radiators dedicated for each frequency band and is free from the shift of its focusing point to each of the primary radiators.

According to a first aspect of the present invention, there is provided an antenna apparatus comprising primary radiators having a plurality of horns, wherein the horns are paired, horns of each pair are arranged at opposite positions with respect to the center of the plurality of horns, and each pair of horns operates at a different frequency band.

According to a second aspect of the present invention, there is provided an antenna apparatus, wherein the center of the plurality of horns is located near the focusing point of a main reflector.

According to a third aspect of the present invention, there is provided an antenna apparatus, wherein each of the primary radiators comprises a pair of horns, one pair of horns is used for transmission, and the other pair is used for reception.

According to a fourth aspect of the present invention, there is provided an antenna apparatus, wherein the aperture size of the horns of one pair is made different from the aperture size of the horns of the other pair.

According to a fifth aspect of the present invention, there is provided an antenna apparatus, wherein each of the primary radiators comprises circuit converters and phase shifters dedicated for a single frequency band and provided corresponding to the number of horns, and a coupler for synthesizing signals received by a pair of horns or a splitter for splitting a transmission signal for a pair of horns.

According to a sixth aspect of the present invention, there is provided an antenna apparatus, wherein each of the primary radiators comprises polarizers and circuit converters dedicated for a single frequency band and provided corresponding to the number of horns, and a coupler for synthesizing signals received by a pair of horns or a splitter for splitting a transmission signal for a pair of horns.

According to a seventh aspect of the present invention, there is provided an antenna apparatus, wherein a feeder line is constructed by a waveguide and the waveguide is part of a support arm of the primary radiator.

According to an eighth aspect of the present invention, there is provided an antenna apparatus, wherein transmission functional elements or reception functional elements are embedded into the side walls of each horn.

According to a ninth aspect of the present invention, there is provided an antenna apparatus, wherein one or both of the transmission functional elements and the reception functional elements are provided with a phase control function.

According to a tenth aspect of the present invention, there is provided an antenna apparatus, wherein one or both of the transmission functional elements and the reception functional elements are provided with a frequency conversion function.

According to an eleventh aspect of the present invention, there is provided an antenna apparatus, wherein a shaped main reflector is used as a main reflector.

According to a twelfth aspect of the present invention, there is provided an antenna apparatus, wherein a shaped main reflector having a reflector surface shaped to compensate for the phase shift of the primary radiator by displacement from a theoretical reflector surface is provided.

The above and other objectives, features and advantages of the invention will become more apparent from the following description when taken in conjunction with the accompanying drawings.

DETAILED DESCRIPTION OF THE PREFERRED EMBODIMENTS

Preferred embodiments of the present invention will be described hereinunder with reference to the accompanying drawings.

The same or corresponding elements as those of the prior art are given the same reference symbols.

Embodiment 1

Figure 1A:
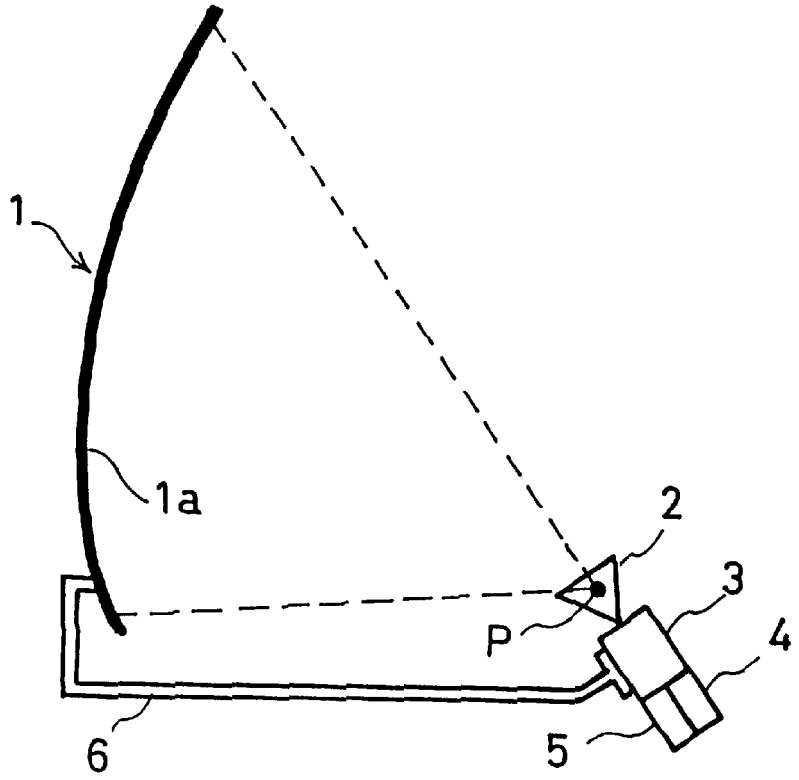
FIGS. 1(*a*) to 1(*c*) are diagrams showing the outer appearance of an antenna apparatus according to Embodiment 1 of the present invention and the arrangement of four horns.
Figure 1B:
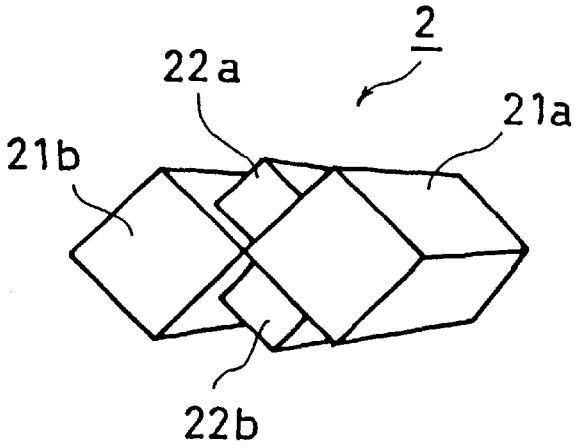
Figure 1C:
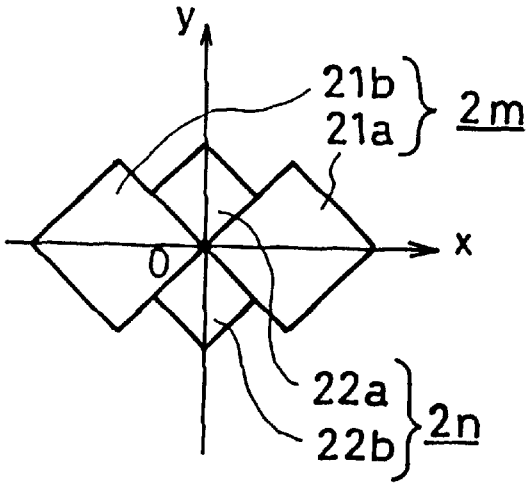

FIG. 1(*a*) is a schematic diagram of an antenna apparatus according to Embodiment 1 of the present invention. Reference numeral 1 denotes a main reflector having an offset paraboloidal reflector surface (to be referred to as "paraboloidal reflector antenna" hereinafter), 2 four rectangular horns having a square aperture, 3 a feeder circuit, 4 a transmitter, 5 a receiver and 6 a support arm for supporting the four horns 2 and the feeder circuit 3. Reference symbol 1*a* indicates the reflector surface of the above paraboloidal reflector antenna 1 and P the focusing point of the paraboloidal reflector antenna 1.

Figure 2:
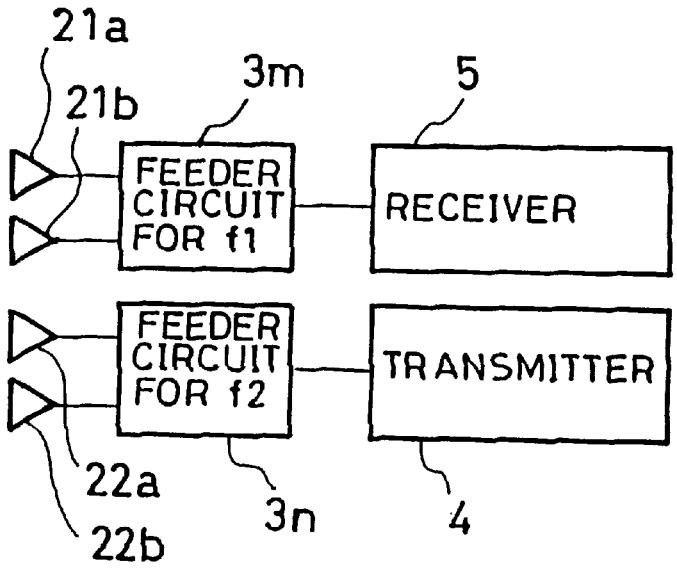
FIG. 2 is a block diagram of the antenna apparatus of Embodiment 1.

FIG. 1(*b*) shows the outer appearance of the four horns 2 and FIG. 1(*c*) is a front view thereof. The four horns 2 consist of a pair 2*m* of horns 21*a* and 21*b* for a lower frequency ($f_1$) having a large aperture and a pair 2*n* of horns 22*a* and 22*b* for a higher frequency ($f_2$) having a small aperture. The horns 22*a* and 22*b* for $f_2$ are arranged such that their square aperture surfaces are disposed in a direction parallel to a vertical line Oy passing over the center point O of the four horns, one of the diagonal lines of each of the square aperture surfaces agrees with the direction of the above vertical line Oy, and they are located at opposite positions with respect to the center point O in a vertical direction. The horns 21*a* and 21*b* for $f_1$ are arranged such that their square aperture surfaces are disposed in a direction parallel to a horizontal line Ox passing over the center point O, one of the diagonal lines of each of the square aperture surfaces agrees with the direction of the horizontal line Ox, and they are located at opposite positions with respect to the center point O in a horizontal direction. As shown in FIG. 2, the horns 21*a* and 21*b* for a lower frequency ($f_1$) of the four horns 2 are both connected to the receiver 5 through a feeder circuit 3*m* for $f_1$ (reception) and the horns 22*a* and 22*b* for a higher frequency ($f_2$) are both connected to the transmitter 4 through a feeder circuit 3*n* for $f_2$ (transmission).

Figure 3A:
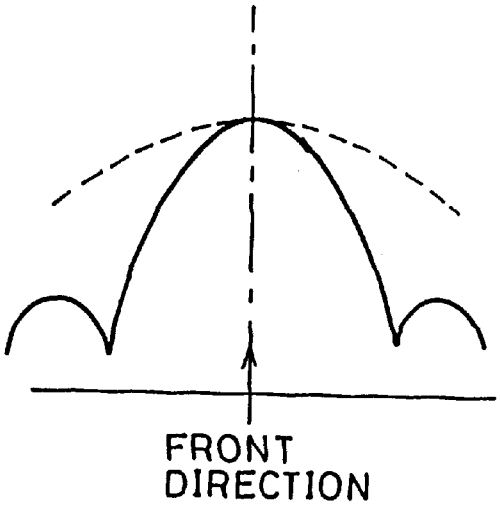
FIGS. 3(*a*) and 3(*b*) are diagrams showing a synthesized radiation pattern from two horns.
Figure 3B:
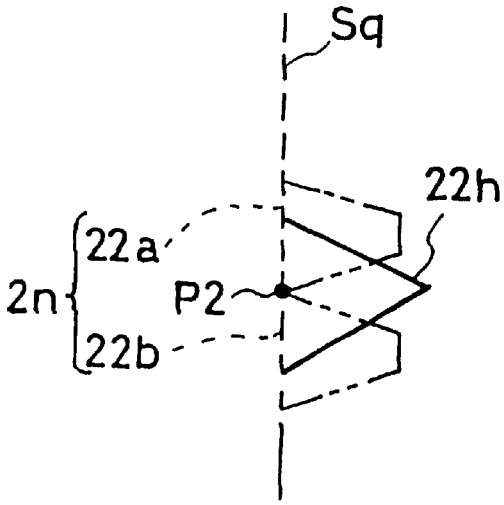

Since the four horns 2 are arranged diagonally as shown in FIG. 1(*b*), a radiation pattern obtained by synthesizing radiation patterns from the horns 22*a* and 22*b* (radiation pattern of the pair 2*n* of horns) is symmetrical about the front direction of the paraboloidal reflector antenna 1 as indicated by a solid line in FIG. 3(*a*). In FIG. 3(*a*), a dotted line indicates a radiation pattern obtained when a single horn is located at the focusing point P of the paraboloidal reflector antenna 1. As shown in FIG. 3(*b*), this radiation pattern can be considered as a radiation pattern of a synthesized horn 22*h* obtained when the pair 2*n* of horns are regarded as the single virtual synthesized horn 22*h* and arranged such that the focusing point P of the paraboloidal reflector antenna 1 is aligned with the focusing point p2 of the synthesized horn 22*h*. Similarly, when the pair 2*m* of horns are regarded as an unshown single virtual synthesized horn and the focusing point of the synthesized horn is aligned with the focusing point P of the paraboloidal reflector antenna, the radiation pattern of the pair 2*m* of horns can be made symmetrical about the front direction of the paraboloidal reflector antenna 1.

That is, when each pair of horns is regarded as a synthesized horn having a center point O as a virtual focusing point and the horns are arranged such that the focusing point of the synthesized horn is aligned with the focusing point P of the paraboloidal reflector antenna 1, an antenna apparatus free from beam displacement can be produced. In the case of the four horns, as shown in FIG. 1(*c*), when the horns 21*a* and 21*b* of the pair 2*m* for a lower frequency ($f_1$) and the horns 22*a* and 22*b* of the pair 2*n* for a higher frequency ($f_2$) are arranged at opposite positions, $f_1$ and $f_2$ do not interfere with each other and beam displacement does not occur at $f_1$ and $f_2$.

According to Embodiment 1 of the present invention, two rectangular horns 21*a* and 21*b* for reception and two rectangular horns 22*a* and 22*b* for transmission are arranged at opposite positions with respect to the center point O of the horns, the center point O is aligned with the focusing point P of the paraboloidal reflector antenna 1, reception signals from the horns 21*a* and 21*b* are synthesized by the feeder circuit 3*m* for $f_1$ (reception) and the synthesized signal is transmitted to the receiver 5 at the time of reception, and a transmission signal from the transmitter 4 is transmitted to the horns 22*a* and 22*b* through the feeder circuit 3*n* for transmission ($f_2$) and radiated from the horns 22*a* and 22*b* to the paraboloidal reflector antenna 1 at the time of transmission. Therefore, since beam displacement does not occur at $f_1$ and $f_2$ and $f_1$ and $f_2$ do not interfere with each other, a high-performance and simple-structured dual antenna apparatus can be obtained. Further, the aperture size of the horns of the pair 2*m* having a lower frequency for reception is made large and the aperture size of the horns of the pair 2*n* having a higher frequency for transmission is made small to adjust the aperture sizes of the horns to the use frequency bands. Therefore, transmission and reception efficiencies can be improved.

Figure 4:
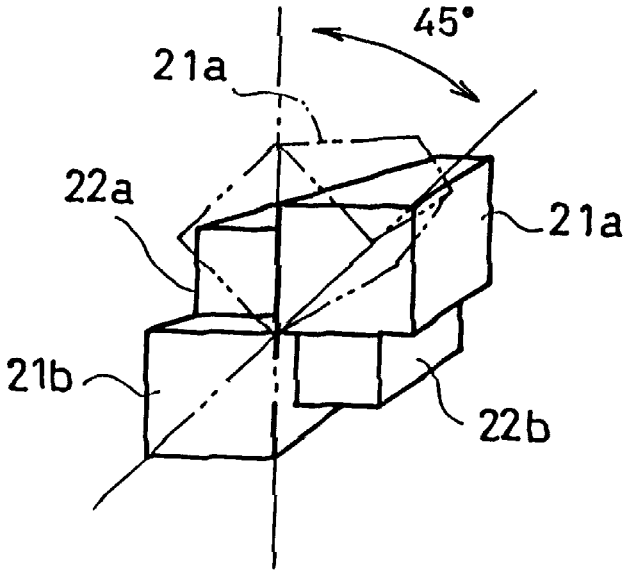
FIG. 4 is a diagram showing another arrangement of four horns.

In the above embodiment, the pair 2*n* of horns for transmission are arranged in a vertical direction and the pair 2*m* of horns for reception are arranged in a horizontal direction. As shown in FIG. 4, the four horns 2 in FIG. 2 may be rotated at 45° within a plane parallel to the aperture surfaces of the horns so that the sides of the square apertures and Ox or Oy become parallel to each other.

Figure 5:
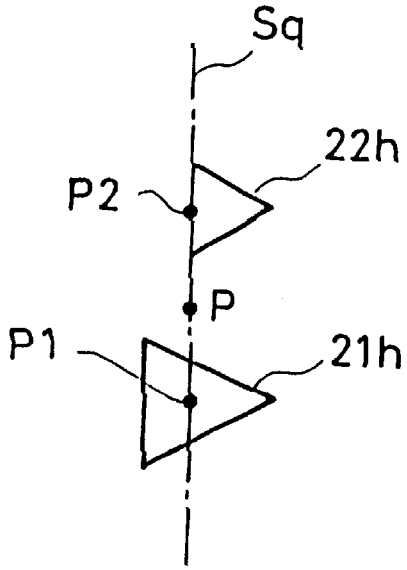
FIG. 5 is a conceptual diagram of the phase alignment of a synthesized horn according to Embodiment 1.

When the phase centers of the synthesized horns for $f_1$ and $f_2$ differ from each other, for example, the phase center p1 of the synthesized horn 21*h* for $f_1$ is located within the synthesized horn 21*h* and the phase center p2 of the synthesized horn 22*h* for $f_2$ is located within the aperture surface of the synthesized horn 22*h* as shown in FIG. 5, the pairs 2*n* and 2*m* of horns are moved such that the phase centers p1 and p2 of the synthesized horns are shifted in a vertical direction and aligned with each other. That is, the pairs of horns may be arranged such that the phase centers p1 and p2 of the synthesized horns for $f_1$ and $f_2$ are aligned with the focusing P of the paraboloidal reflector antenna 1.

Embodiment 2

Figure 6A:
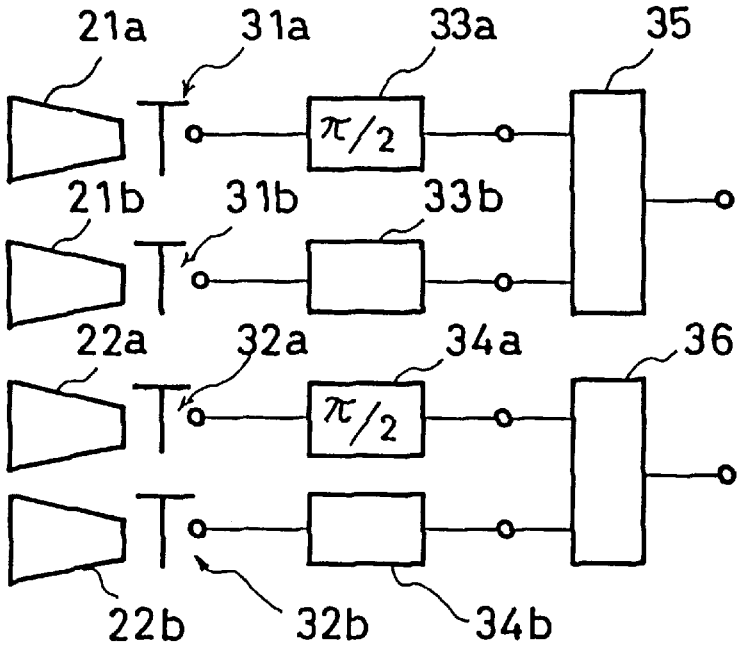
FIGS. 6(*a*) and 6(*b*) are diagrams showing the configuration of a primary radiator according to Embodiment 2 of the present invention.
Figure 6B:
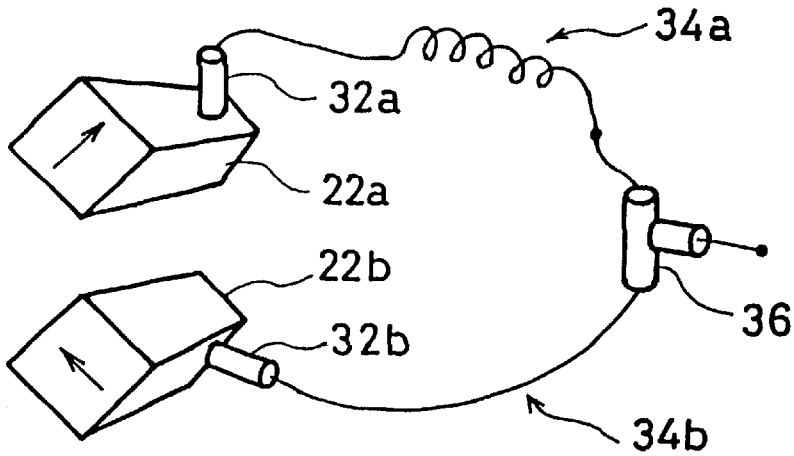

In the above Embodiment 1, the feeder circuit 3 is a feeder circuit which is conventionally used for linearly polarized waves. When circularly polarized waves are used, horns and feeder circuits (to be referred to as "primary radiators" hereinafter) as shown in FIGS. 6(*a*) and 6(*b*) are used to enable the high-precision transmission and reception of circularly polarized waves. FIG. 6(*a*) is a block diagram of the above primary radiator and FIG. 6(*b*) shows the details of a primary radiator for transmission ($f_2$). In the primary radiator for transmission ($f_2$), the horn 22*a* is connected to a splitter 36 through a coaxial/horn converter 32*a* which is a circuit converter and a 90° phase shifter 34*a*, and the other horn 22*b* is connected to the splitter 36 through a coaxial/horn converter 32*b* and a feeder line 34*b*. There is a phase difference of 90° between the system of the horn 22*a* having the above 90° phase shifter 34*a* and the system of the horn 22*b*. The directions of polarized waves radiated from the horns 22*a* and the horn 22*b* cross each other at 90°. Therefore, a circularly polarized wave can be radiated by spatially synthesizing two polarized waves which cross each other at 90° and have a phase difference of 90°.

In the primary radiator for reception ($f_1$), the horn 21*a* is connected to a coupler 35 through a coaxial/horn converter 31*a* and a 90° phase shifter 33*a* composed of a coaxial line having a required length, and the horn 21*b* is connected to the coupler 35 through a coaxial/horn converter 31*b* and a feeder line 33*b*. Therefore, the system of the horn 21*a* and the system of the horn 21*b* cross each other at 90° as well. Accordingly, by synthesizing a circularly polarized wave from the horn 21*a* and a circularly polarized wave from the horn 21*b*, circularly polarized waves can be converted into a linearly polarized wave which is transmitted to the unshown receiver 5, thereby making possible high-precision reception.

Embodiment 3

Figure 7A:
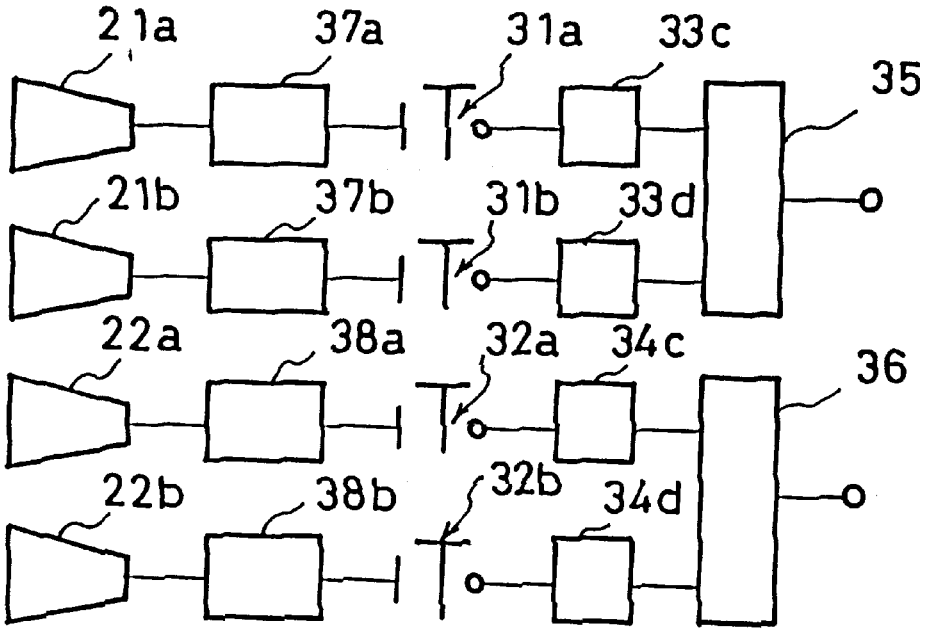
FIGS. 7(*a*) and 7(*b*) are diagrams showing the configuration of a primary radiator according to Embodiment 3 of the present invention.
Figure 7B:
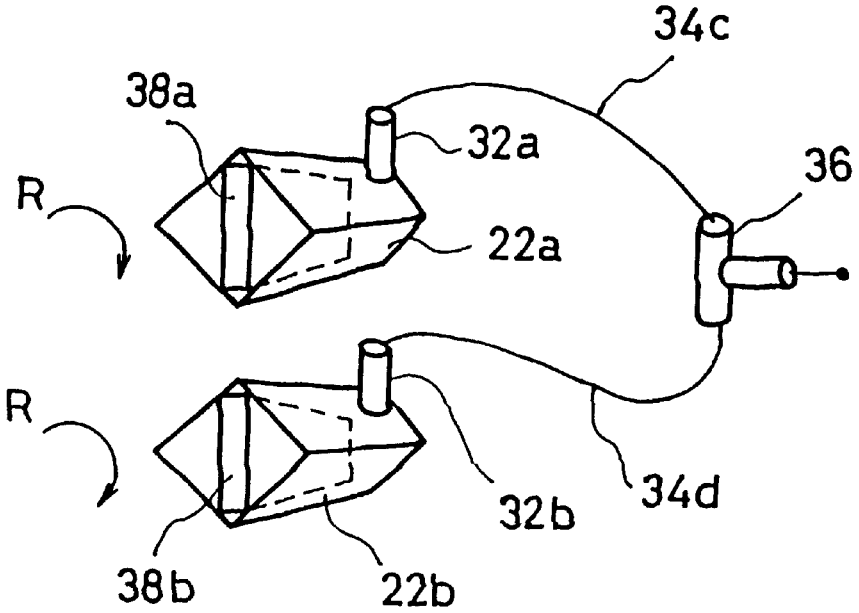

FIG. 7(*a*) shows other configuration of a primary radiator in the case of a circularly polarized wave and FIG. 7(*b*) shows the details of a primary radiator for $f_2$. In the primary radiator for transmission ($f_2$), 90° phase shifters 38*a* and 38*b* which are polarizers are connected to the horns 22*a* and 22*b*, respectively, so that linearly polarized waves transmitted from a splitter 36 to the horns 22*a* and 22*b* through coaxial/horn converters 34*c* and 34*d* are converted into circularly polarized waves by the 90° phase shifters 38*a* and 38*b*, respectively, and the circularly polarized waves are radiated, thereby making possible the high-precision transmission of circularly polarized waves. FIG. 7(*b*) shows a case where both of the horns 22*a* and 22*b* excite clockwise circularly polarized waves.

Similarly, 90° phase shifters 37*a* and 37*b* are connected to the horns 21*a* and 21*b*, respectively, in the primary radiator for reception ($f_1$) so that their outputs are synthesized by a coupler 35 through coaxial/horn converters 31*a* and 31*b* and feeder lines 33*c*and 33*d*. Circularly polarized waves transmitted to the horns 21*a* and 21*b* are converted by the 90° phase shifters 37*a* and 37*b* into linearly polarized waves which are then synthesized by the coupler 35. Since the above primary radiator for $f_1$ receives circularly polarized waves which are clockwise like the primary radiator for $f_2$, or counterclockwise, high-precision reception is possible.

Embodiment 4

Figure 8:
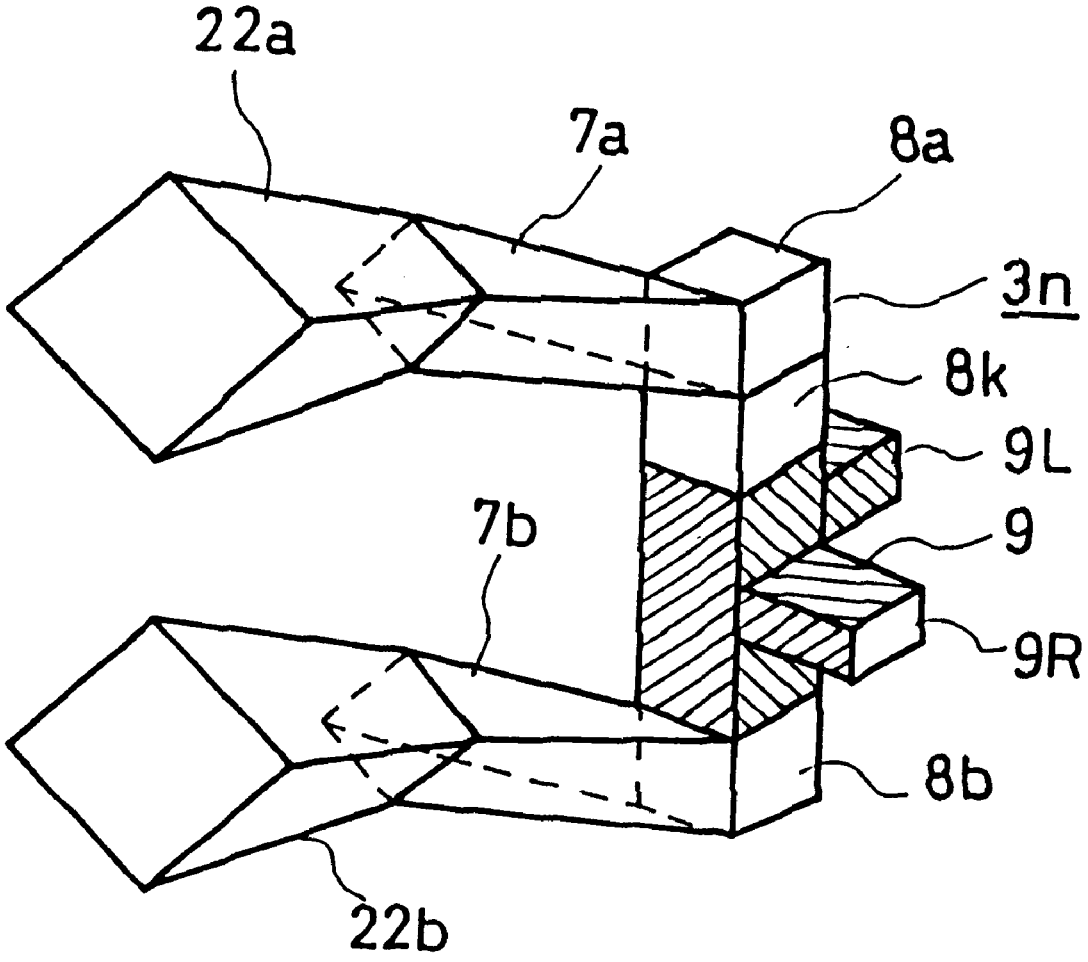
FIG. 8 is a diagram showing the configuration of a primary radiator according to Embodiment 4 of the present invention.

FIG. 8 shows the configuration of a primary radiator (for $f_2$) which can transmit both clockwise and counterclockwise circularly polarized waves at the same time. In the primary radiator for transmission ($f_2$), the horns 22*a* and 22*b* and a feeder circuit 3*n* connected to the horns 22*a* and 22*b* are constructed by a waveguide circuit. The output of the unshown transmitter 4 is applied to any one of the terminals of a magic T9 having an R terminal 9R which is an input terminal for a clockwise polarized wave and an L terminal 9L which is an input terminal for a counterclockwise polarized wave. Both of the terminals are provided on the input side of the feeder circuit 3*n*. A signal input from one of the terminals changes its direction toward the horn 22*a* in a 90° corner 8*a* through a 90° phase shifter 8*k* and is radiated from the horn 22*a* through a rhombic/square converter 7*a*, and a signal input from the other terminal simply changes its direction toward the horn 22*b* in a 90° corner 8*b* and is radiated from the horn 22*b* through a rhombic/square converter 7*b*. Therefore, since the system of the horn 22*a* and the system of the horn 22*b* cross each other at 90° like the above Embodiment 2, the directions of linearly polarized waves radiated from the horn 22*a* and the horn 22*b* cross each other at 90°. As there is a 90° phase difference between these polarized waves, a circularly polarized wave can be radiated by spatially synthesizing the two linearly polarized waves which cross each other at 90°.

It is needless to say that the primary radiator for reception ($f_1$) can be constructed by a waveguide circuit like the primary radiator for transmission ($f_2$).

When the primary radiators for transmission and reception are constructed by a waveguide circuit, an antenna apparatus can be further reduced in size. The above embodiment is materialized by constructing all the primary radiators of Embodiment 3 by a waveguide circuit.

Embodiment 5

Figure 9A:
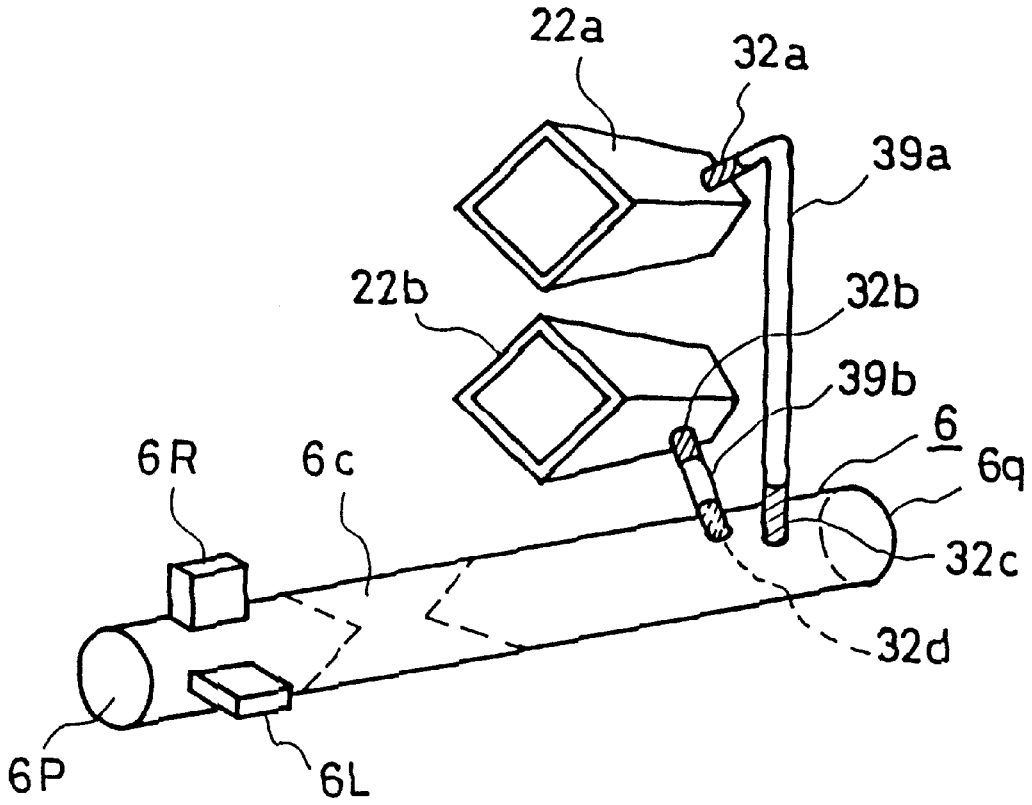
FIGS. 9(*a*) and 9(*b*) are diagrams showing the configuration of a primary radiator according to Embodiment 5 of the present invention.
Figure 9B:
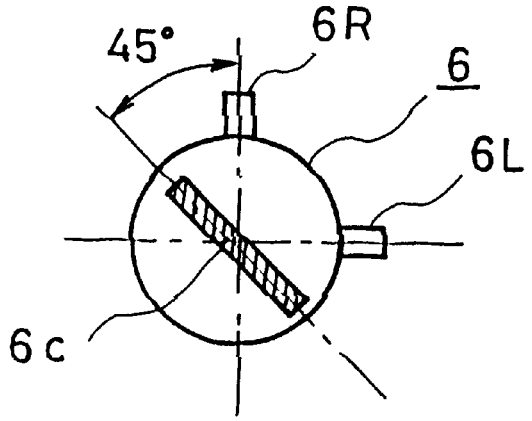

FIG. 9(*a*) shows the configuration of a primary radiator for transmission ($f_2$) according to Embodiment 5 of the present invention. A support arm 6 for supporting the horns 22*a* and 22*b* is constructed by a circular waveguide having both short-circuited terminals 6*p* and 6*q*, an L output terminal 6L and an R output terminal 6R are provided at positions where they cross each other at 90° of an end portion on an opposite side to the horns 22*a* and 22*b* of the waveguide, and a 90° phase shifter 6*c* which is inclined at 45° with respect to the above terminals 6R and 6L is provided in a center portion of the waveguide as shown in the sectional view of FIG. 9(*b*) so that the support arm 6 is also used as a feeder circuit. Thereby, an area occupied by the primary radiator is made small and an antenna apparatus can be further reduced in size. The horns 22*a* and 22*b* are connected to the circular waveguide (support arm 6) by coaxial/horn converters 32*a* and 32*b*, coaxial lines 39*a* and 39*b,* and coaxial/waveguide converters 32*c* and 32*d,* respectively. A primary radiator for reception ($f_1$) is constructed the same as the primary radiator for transmission ($f_2$).

Embodiment 6

Figure 10A:
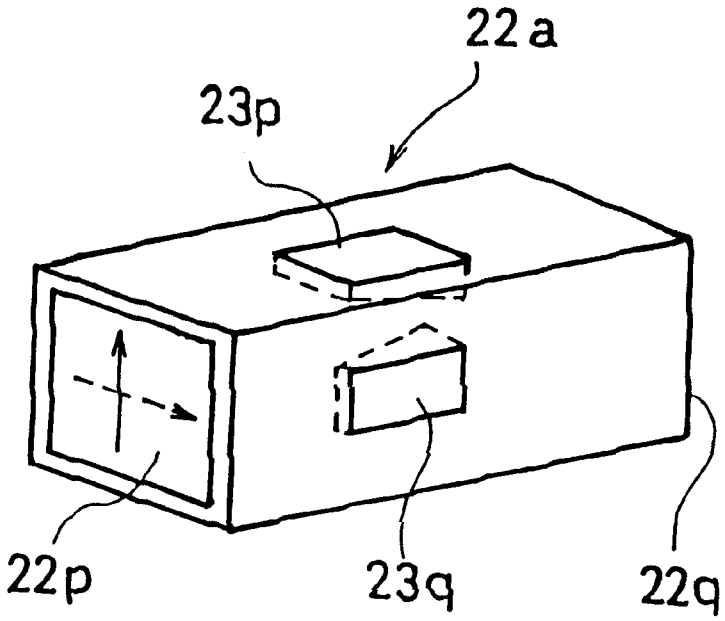
FIGS. 10(*a*) and 10(*b*) are schematic diagrams of a horn according to Embodiment 6 of the present invention.
Figure 10B:
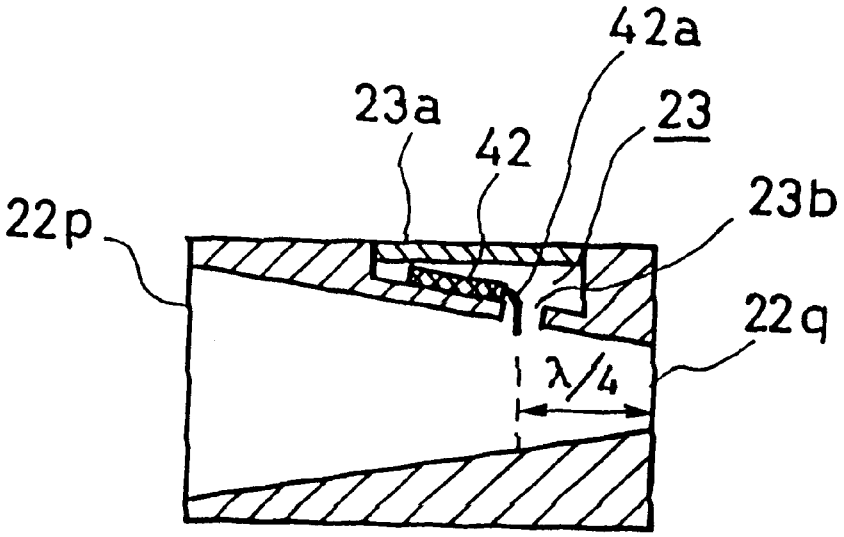

FIG. 10(*a*) is a schematic diagram showing the structure of the horn 22*a* for transmission ($f_2$) according to Embodiment 6 of the present invention. FIG. 10(*b*) is a sectional view of the horn 22*a.* Grooves 23 (23*p*, 23*q*) are formed on two adjacent outer side walls of the horn 22*a* having a square aperture, a cover 23*a* is provided on the outer wall side of each of the grooves 23, a through hole 23*b* is formed at a λ/4 position of the groove 23 (λis the wavelength of the frequency) from a short-circuit side surface 22*q* which is opposite to a horn aperture portion 22*p,* and two transmission functional elements 42 for transmitting two polarized waves which cross each other at 90° are embedded into the respective grooves 23. A polarized wave directed as shown by the solid line of FIG. 10(*a*) is excited from the transmission functional element embedded in the groove 23*p* and a polarized wave which crosses the above polarized wave at 90° and is shown by the dotted line of FIG. 10(*a*) is excited from the transmission functional element embedded in the groove 23*q*. The inner wall of the horn 22*a* becomes narrower toward the short-circuit side surface 22*q* from the aperture portion 22*p,* and the transmission functional elements 42 are embedded such that the horn 22*a* side end of a coaxial probe 42*a* connecting the transmission functional element 42 and the horn 22*a* is located at the position of the above through hole 23*b*.

The horn 22*b* for transmission ($f_2$) has completely the same structure as the above horn 22*a,* and the horns 21*a* and 21*b* for reception ($f_1$) have the same structure as the above horns 22*a* and 22*b* except that the embedded elements are not the transmission functional elements 42 but reception functional elements. An antenna apparatus can be reduced in size by embedding transmission functional elements or reception functional elements into each horn.

Figure 11:
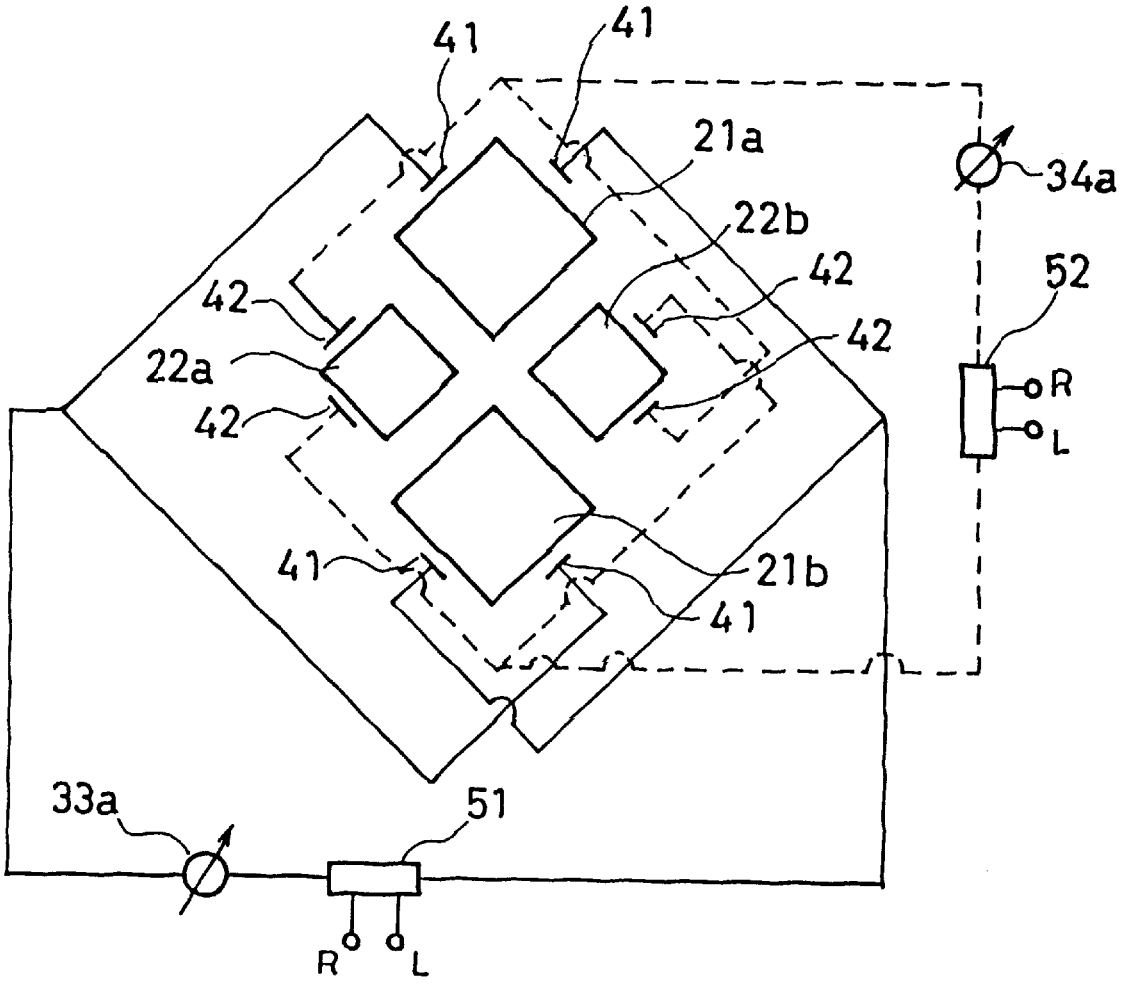
FIG. 11 is a diagram showing the configuration of a primary radiator according to Embodiment 6.

FIG. 11 shows the entire configuration of primary radiators comprising four horns 2 incorporating transmission functional elements 42 and 42 which are the transmitter 4 or reception functional elements 41 and 41 which are the receiver 5. Line connections for reception are indicated by solid lines and line connections for transmission are indicated by broken lines. A combination of the horns (21*a* and 21*b,* or 22*a* and 22*b*) incorporating the transmitters 4 or the receivers 5 and the feeder circuits 3 is called "primary radiator" for convenience's sake. As shown in FIG. 11, this primary radiator has a 90° phase shifter 33*a* between ones of the reception functional elements 41 of the horns 21*a* and 21*b* and an input terminal 51, or a 90° phase shifter 34*a* between ones of the transmission functional elements 42 of the horns 22*a* and 22*b* and an input terminal 52 to synthesize two mutually orthogonal wave components in the case of $f_1$ and split into two mutually orthogonal wave components in the case of $f_2$. Therefore, this primary radiator is a primary radiator for transmitting or receiving a circularly polarized wave, which provides a 90° phase difference between components which cross each other at 90°.

Figure 12A:
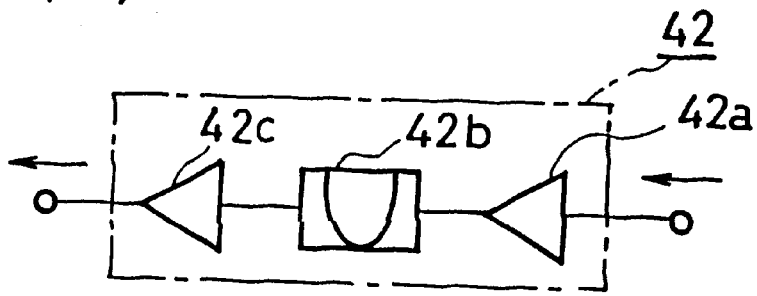
FIGS. 12(*a*) and 12(*b*) are diagrams showing the configurations of a transmitter and a receiver according to Embodiment 6, respectively.
Figure 12B:
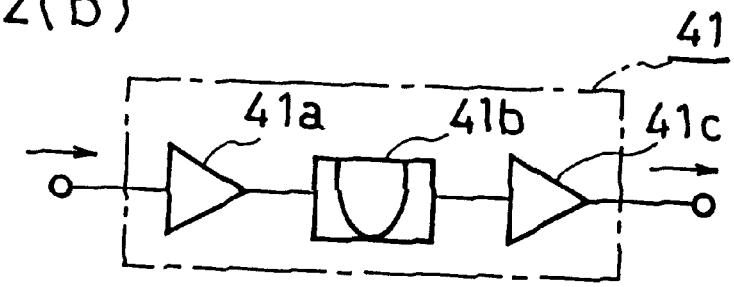
Figure 13:
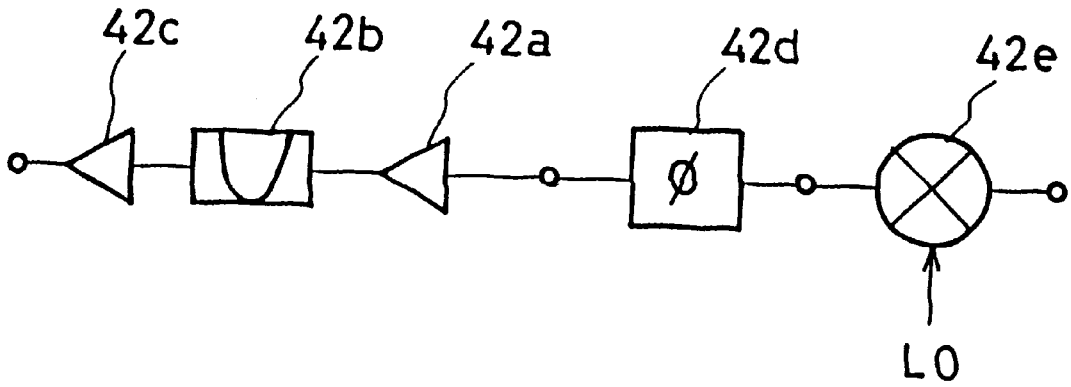
FIG. 13 is a diagram showing another configuration of a transmitter according to Embodiment 6.
Figure 14A:
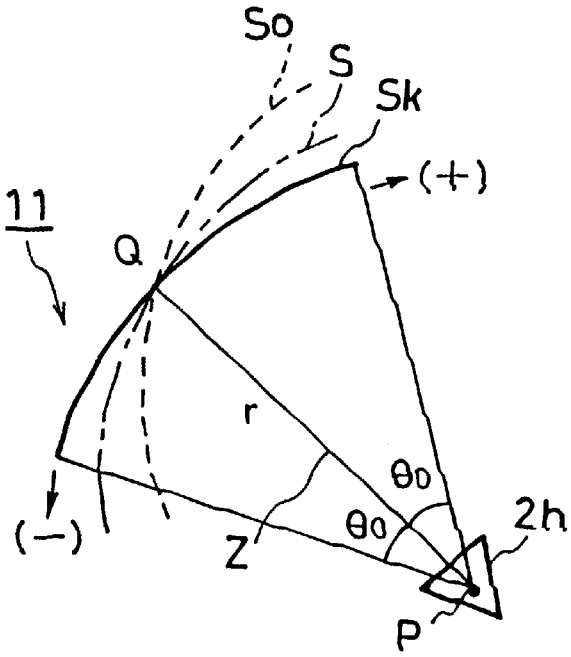
FIGS. 14(*a*) to 14(*d*) are diagrams for explaining the shaping of the reflector surface of an offset paraboloidal reflector antenna according to Embodiment 7 of the present invention.
Figure 14B:
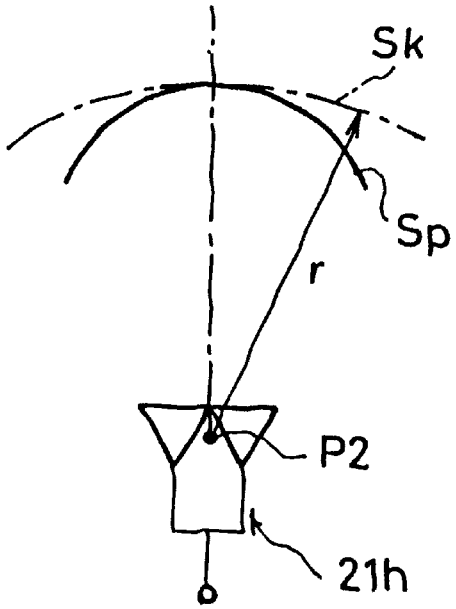
Figure 14C:
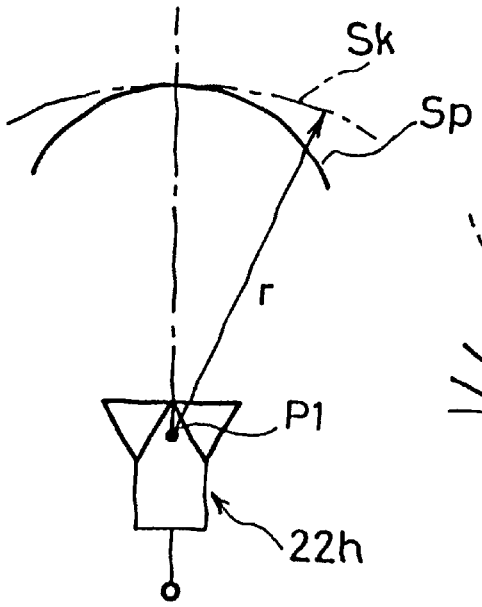
Figure 14D:
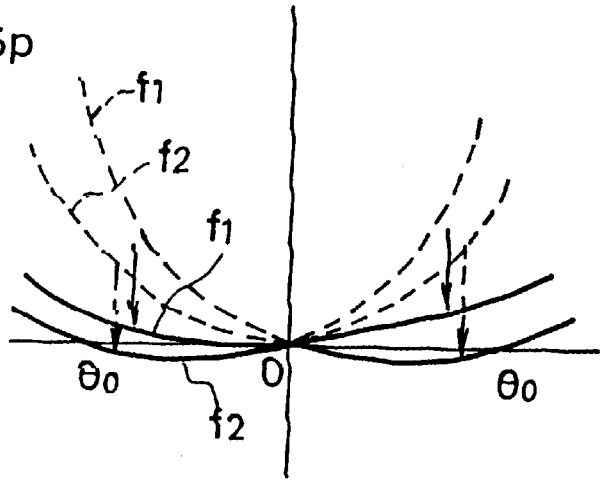
Figure 15A:
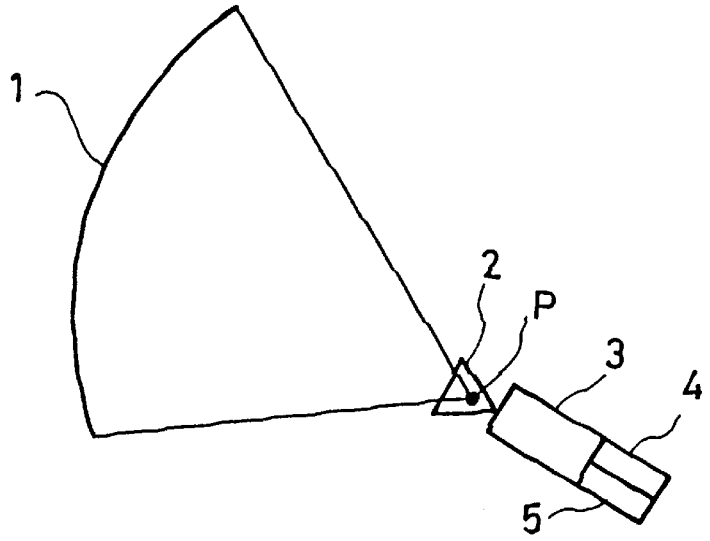
FIG. 15(a) PRIOR ART
FIGS. 15(*a*) to 15(*c*) are diagrams showing the outer appearance and configuration of a conventional antenna apparatus.
Figure 15B:
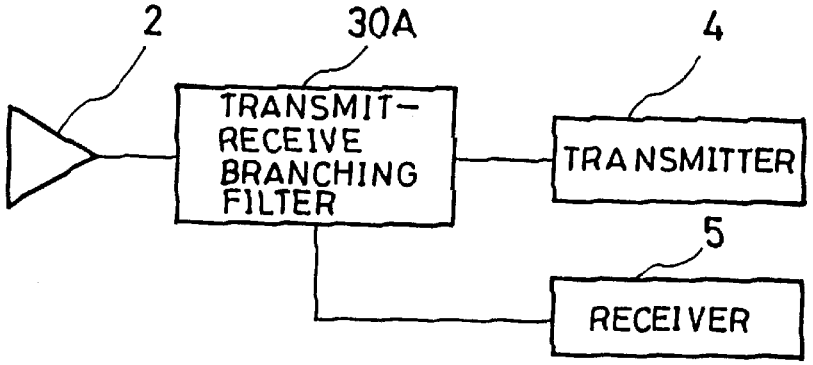
FIG. 15(b) PRIOR ART
Figure 15C:
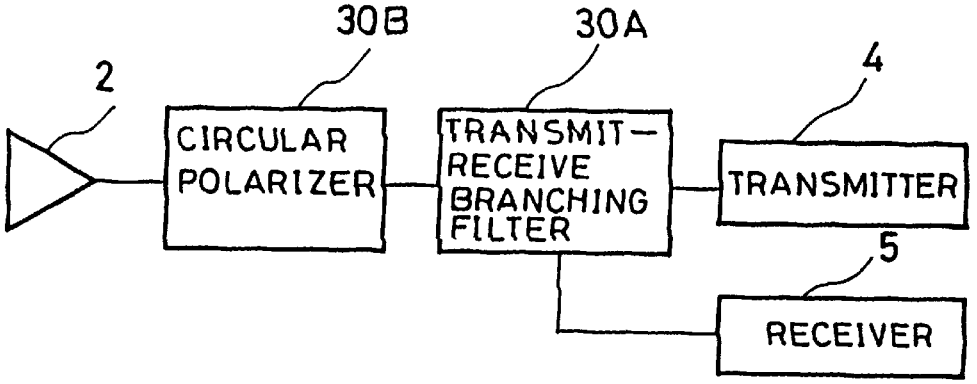
FIG. 15(c) PRIOR ART
Figure 16A:
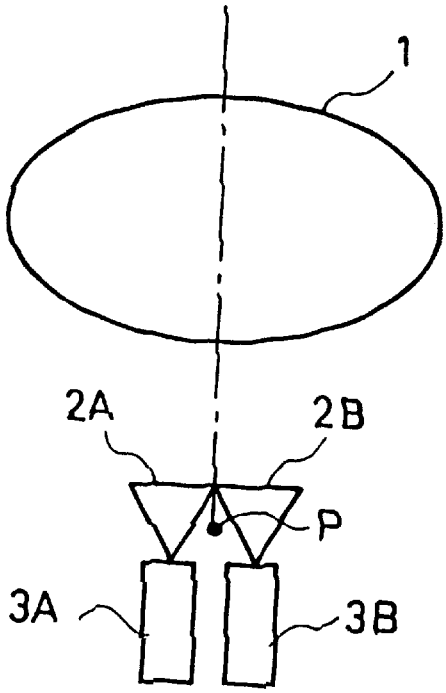
FIG.16(a) PRIOR ART
FIGS. 16(A) and 16(*b*) are diagrams showing the outer appearance and configuration of another conventional antenna apparatus.
Figure 16B:
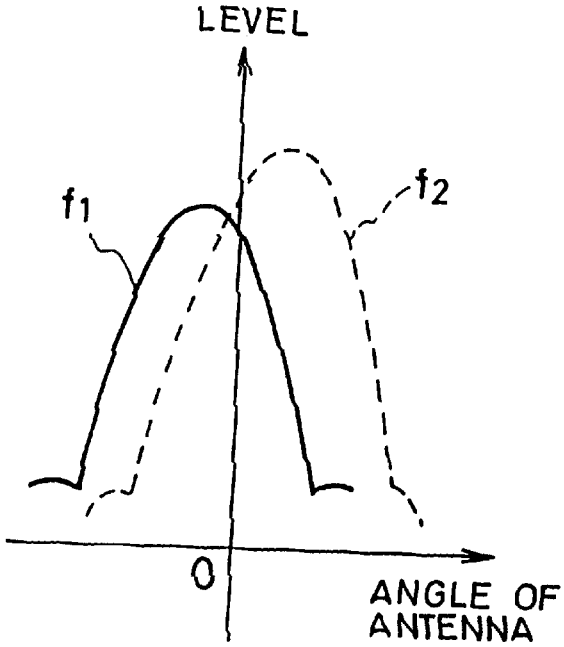
FIG.16(b) PRIOR ART
Figure 17A:
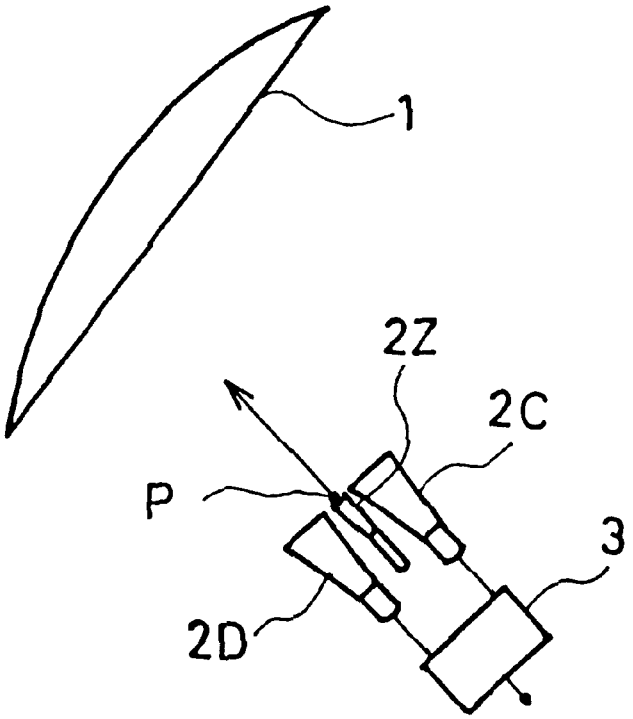
FIG. 17(a) PRIOR ART
FIGS. 17(*a*) and 17(*b*) are diagrams showing the outer appearance and configuration of still another conventional antenna apparatus.
Figure 17B:
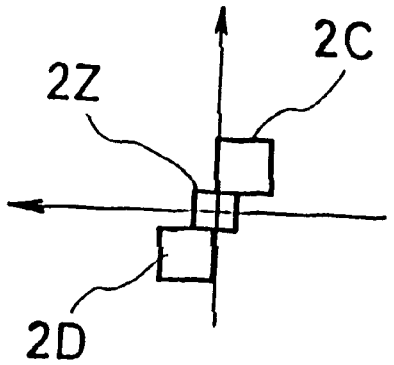
FIG. 17(b) PRIOR ART
Figure 18A:
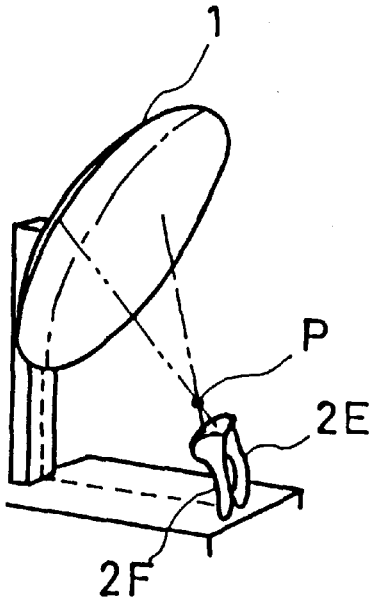
FIG. 18(a) PRIOR ART
FIGS. 18(*a*) to 18(*d*) are diagrams showing the outer appearance and configuration of a further conventional antenna apparatus.
Figure 18B:
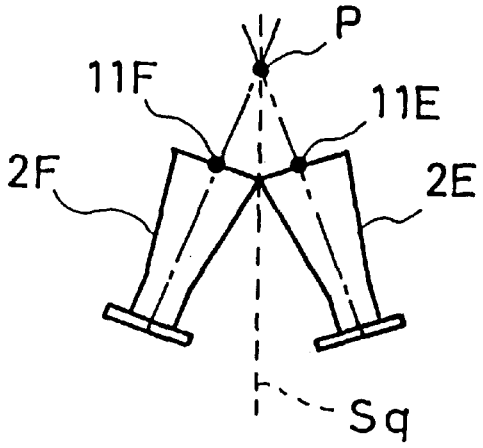
FIG. 18(b) PRIOR ART
Figure 18C:
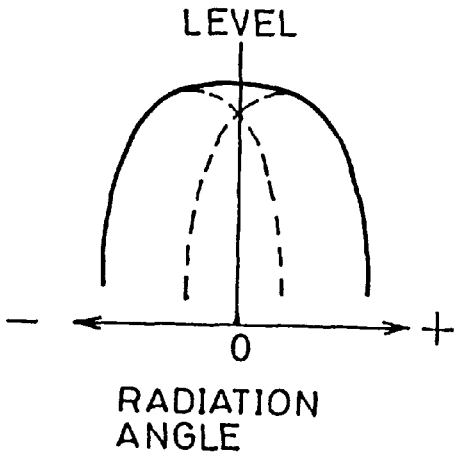
FIG. 18(c) PRIOR ART
Figure 18D:
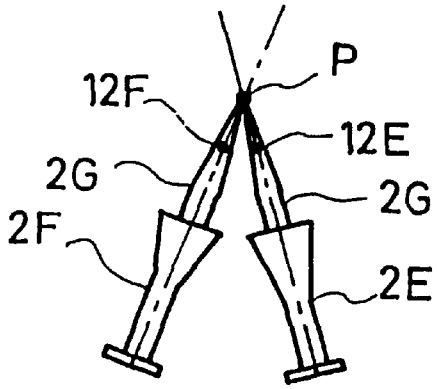
FIG. 18(d) PRIOR ART

FIG. 12(*a*) is a block diagram showing the configuration of a transmission functional element 42. Reference symbol 42*a* denotes a first-stage amplifier, 42*b* a band-pass filter (BPS), and 42*c* a last-stage amplifier. FIG. 12(*b*) is a block diagram showing the configuration of a reception functional element 41. Like the transmission functional element, it comprises a first-stage amplifier 41*a,* a BPS 41*b* and a last-stage amplifier 41*c*. FIG. 13 shows that a variable phase shifter 42*d* and a mixer 42*e* are added to the transmission functional element 42 to provide a variable phase function and a frequency conversion function. A variable phase shifter and a mixer are also added to the reception functional element 41 to provide a variable phase function and a frequency conversion function. Thereby, the phase characteristics of transmission and reception can be improved and a signal can be transmitted or received by an intermediate frequency.

Embodiment 7

FIG. 14(*a*) shows an example of a reflector surface shaping offset paraboloidal reflector antenna 11 whose gain and side lobe characteristics are improved by changing the theoretical reflector surface So of the offset paraboloidal reflector antenna to a shaped reflector surface S which is shaped to compensate for the phase pattern of a synthesized horn 2*h* (the synthesized horn 21*h* for reception or the synthesized horn 22*h* for transmission), using the phase pattern of the synthesized horn 2*h* on the observation surface Sk of the synthesized horn 2*h*. Before reflector shaping, as shown in FIGS. 14(*b*) and 14(*c*), the phase pattern Sp of the synthesized horn 21*h* or 22*h* is a wave surface lagged with respect to the phase reference surface of the synthesized horn 21*h* or 22*h* (the same as the observation surface Sk and an arc with a virtual center p1 or p2 as the center thereof). Therefore, there are large phase shifts in the phase characteristics of $f_1$ and $f_2$ before reflector shaping as shown by dotted lines of FIG. 14(*d*). This is because the virtual phase centers of both $f_1$ and $f_2$ are not aligned with the focusing point of the paraboloidal reflector antenna. Then, the phase shift is corrected based on displacement from the theoretical reflector surface So. In the above embodiment, the phase shifts of the frequencies $f_1$ and $f_2$ are well balanced, and then the amount of a phase lag is compensated by shaping the paraboloidal reflector antenna 1, whereby the phase shifts of $f_1$ and $f_2$ can be reduced as shown by the solid lines of FIG. 14(*d*) and the antenna performance can be optimized at the respective frequencies.

As described above, according to the first aspect of the present invention, the antenna apparatus has primary radiators having a plurality of horns, the horns are paired, two horns of each pair are arranged at opposite positions with respect to the center of the plurality of horns, the synthesized radiation pattern of each pair of the horns is made symmetrical, and each pair of horns operates at a different frequency band. Therefore, a high-performance and multi-frequency antenna apparatus which is free from beam displacement at these frequency bands and interference between these frequency bands can be obtained.

According to the second aspect of the present invention, since the center of the plurality of horns is arranged near the focusing point of the main reflector, the focusing point of the reflector can be aligned with the phase center of each pair of horns without fail.

Therefore, the shift of the focusing point to the primary radiator can be prevented.

According to the third aspect of the present invention, each of the primary radiators comprises a pair of horns, one pair of horns is used for transmission, and the other pair is used for reception. Therefore, a simple-structured high-performance and dual antenna apparatus can be obtained.

According to the fourth aspect of the present invention, since the aperture size of the horns of one pair is made different from that of the horns of the other pair, a transmission or reception signal can be transmitted or received by horns having an aperture size suitable for a transmission or reception frequency band. Therefore, the performance of the antenna apparatus can be further improved.

According to the fifth aspect of the present invention, each of the primary radiators comprises circuit converters and phase shifters dedicated for a single frequency band and provided corresponding to the number of horns, and a coupler for synthesizing signals received by a pair of horns, or a splitter for splitting a transmission signal for a pair of horns. Therefore, the synthesized radiation pattern of each pair of horns can be made symmetrical without fail in the transmission and reception of circularly polarized waves.

According to the sixth aspect of the present invention, since each of the primary radiators comprises polarizers and circuit converters dedicated for a single frequency band and provided corresponding to the number of horns, and a coupler for synthesizing signals received by a pair of horns or a splitter for splitting a transmission signal for a pair of horns. Therefore, circularly polarized waves can be transmitted or received by a pair of horns, and the synthesized radiation pattern of each pair of the horns can be made symmetrical without fail.

According to the seventh aspect of the present invention, a feeder line is constructed by a waveguide and the waveguide is part of a support arm of the primary radiator. Therefore, an area occupied by the primary radiator becomes small and the antenna apparatus can be reduced in size.

According to the eighth aspect of the present invention, since transmission functional elements or reception functional elements are embedded into the side walls of each horn, transmission and reception can be processed within the horn, a transmission loss is minimized, and the apparatus can be reduced in size.

According to the ninth aspect of the present invention, since one or both of the transmission functional elements and the reception functional elements are provided with a phase control function, the phase characteristics of the antenna apparatus can be further improved.

According to the tenth aspect of the present invention, since one or both of the transmission functional elements and the reception functional elements are provided with a frequency conversion function, a signal can be transmitted or received by an intermediate frequency.

According to the eleventh aspect of the present invention, since a shaped main reflector is used as the main reflector, the focusing point of the reflector can be aligned with the phase center of each pair of horns precisely and the performance of the antenna apparatus can be improved.

According to the twelfth aspect of the present invention, since a shaped main reflector having a reflector surface shaped to compensate for the phase shift of the primary radiator by displacement from the theoretical reflector surface is provided, the accuracy of reflector surface shaping can be further improved.

What is claimed is:

1. Antenna apparatus, comprising:

a main reflector having a focus point, and at least two primary radiators, each primary radiator having a pair of horns, each of said pair of horns being arranged at opposite positions with respect to a center of said pair, each of said pair of horns having a combined radiation pattern and being arranged with respect to said main reflector such that a phase center of said combined radiation pattern is aligned with said focus point.

2. The antenna apparatus of claim 1, wherein the phase center of each of the plurality of horns is located near the focus point of the main reflector.

3. The antenna apparatus of claim 1, wherein for each of the primary radiators, one pair of horns is used for transmission, and the other pair is used for reception.

4. The antenna apparatus of claim 3, wherein the aperture size of the horns of one pair is made different from the aperture size of the horns of the other pair.

5. The antenna apparatus of claim 3, wherein transmission functional elements or reception functional elements are embedded into the side walls of each horn.

6. The antenna apparatus of claim 5, wherein one or both of the transmission functional elements and the reception functional elements are provided with a phase control function.

7. The antenna apparatus of claim 5, wherein one or both of the transmission functional elements and the reception functional elements are provided with a frequency conversion function.

8. The antenna apparatus of claim 1, wherein said main reflector has a shaped reflector surface.

9. The antenna apparatus of claim 8, wherein the reflector surface is shaped to compensate for the phase shift of the primary radiator by displacement from a theoretical reflector surface.

10. Antenna apparatus, comprising:

a main reflector having a focus point, and a plurality of primary radiators each having a plurality of horns, each of said plurality of horns being arranged at opposite positions with respect to a center of said plurality of horns;

each of the primary radiators including a circuit converter and a phase shifter provided for each of said plurality of horns, said circuit converter and phase shifter dedicated to a single frequency band, and a coupler/splitter for synthesizing signals received by a pair of horns and splitting a transmission signal for said pair of horns.

11. Antenna apparatus, comprising:

a main reflector having a focus point, and a plurality of primary radiators each having a plurality of horns, each of said plurality of horns being arranged at opposite positions with respect to a center of said plurality of horns;

each of the primary radiators including a circuit converter and a polarizer provided for each of said plurality of horns, said circuit converter and polarizer dedicated to a single frequency band, and a coupler/splitter for synthesizing signals received by a pair of horns and splitting a transmission signal for said pair of horns.

12. The antenna apparatus of claim 11, wherein a feeder line is constructed by a waveguide and the waveguide is part of a support arm of the primary radiator.

* * * * *